US009022253B2

(12) United States Patent
Oster et al.

(10) Patent No.: US 9,022,253 B2
(45) Date of Patent: May 5, 2015

(54) CARRY HANDLE FOR A CONTAINER

(75) Inventors: Werner Oster, Kleve (DE); Ludger Pauls, Ven-Zelderheide (DE); Thomas Stienen, Unna (DE)

(73) Assignee: KHS GmbH, Dortmund (DE)

( * ) Notice: Subject to any disclaimer, the term of this patent is extended or adjusted under 35 U.S.C. 154(b) by 172 days.

(21) Appl. No.: 13/058,311

(22) PCT Filed: Jul. 27, 2009

(86) PCT No.: PCT/EP2009/005415

§ 371 (c)(1),
(2), (4) Date: Feb. 9, 2011

(87) PCT Pub. No.: WO2010/043281

PCT Pub. Date: Apr. 22, 2010

(65) Prior Publication Data

US 2011/0147397 A1 Jun. 23, 2011

(30) Foreign Application Priority Data

Oct. 14, 2008 (DE) ..... 10 2008 051 208

(51) Int. Cl.
*B65D 25/28* (2006.01)
*B65D 71/56* (2006.01)

(52) U.S. Cl.
CPC .. *B65D 71/0018* (2013.01); *B65D 2571/00493* (2013.01); *B65D 2571/00512* (2013.01)

(58) Field of Classification Search
CPC ..... B65D 17/0018; B65D 2571/00493; B65D 2571/00512
USPC ..... 220/318, 212.5, 846, 710.5, 752, 753, 220/754, 755, 757, 758, 759, 760, 761, 762, 220/764, 767, 768, 769, 770, 771, 773, 774, 220/775, 776
See application file for complete search history.

(56) References Cited

U.S. PATENT DOCUMENTS

| | | | | | |
|---|---|---|---|---|---|
| 101,113 | A | * | 3/1870 | Erpelding | 220/6 |
| 2,114,737 | A | * | 4/1938 | Gray | 220/6 |
| 2,817,552 | A | * | 12/1957 | Bruel | 292/259 R |
| 2,951,615 | A | * | 9/1960 | Crane | 220/754 |
| 2,983,406 | A | | 5/1961 | Arneson | |
| 3,219,233 | A | * | 11/1965 | Whiteford | 206/203 |
| 3,927,812 | A | * | 12/1975 | Winters et al. | 220/759 |
| 4,742,915 | A | * | 5/1988 | Ringer | 206/575 |

(Continued)

FOREIGN PATENT DOCUMENTS

| | | |
|---|---|---|
| DE | 29 50 794 | 7/1980 |
| DE | 42 24 696 A1 | 1/1994 |

(Continued)

*Primary Examiner* — Robert J Hicks
*Assistant Examiner* — Kareen Rush
(74) *Attorney, Agent, or Firm* — Occhiuti & Rohlicek LLP

(57) ABSTRACT

The invention relates to a carry basket, preferably a cardboard carry basket, having a carry basin for receiving a product to be transported, and having a carry handle connected to the carry basin, wherein the carry handle is designed as a grip handle, wherein the carry handle is designed as a handle strap connected to at least two side walls of the carry basin and shortened by at least one fold prior to being used, and wherein the handle strap overlaps the products present in the carry basin and/or engages as a spacer between the products, and thereby secures the products during transport, for example.

17 Claims, 3 Drawing Sheets

(56) References Cited

U.S. PATENT DOCUMENTS

Figure 1A:
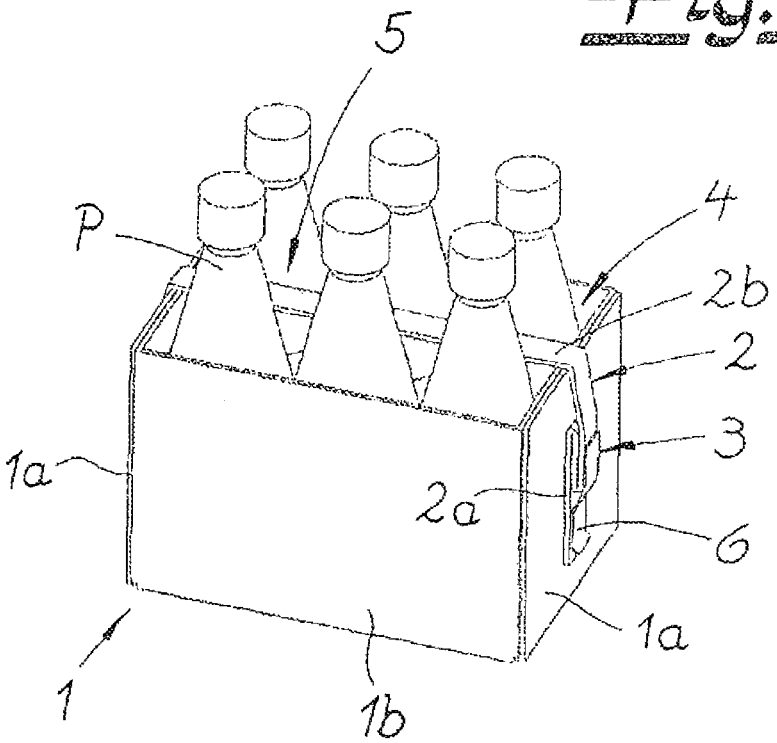

| | | | | |
|---|---|---|---|---|
| 5,080,281 | A * | 1/1992 | Seabold | 229/117.22 |
| 6,220,506 | B1 * | 4/2001 | Knight | 229/117.22 |
| 6,513,657 | B2 * | 2/2003 | Sheehan, Jr. | 206/497 |
| 8,032,986 | B2 * | 10/2011 | Lawrence | 16/114.1 |
| 2010/0001013 | A1 * | 1/2010 | Sommerfeld | 220/754 |

FOREIGN PATENT DOCUMENTS

| | | |
|---|---|---|
| DE | 697 01 457 | 7/2000 |
| DE | 203 15 008 | 4/2004 |
| DE | 20315008 | 5/2004 |
| DE | 10 2006 049 147 | 4/2008 |
| FR | 2653747 | 5/1991 |

* cited by examiner

CARRY HANDLE FOR A CONTAINER

CROSS-REFERENCE TO RELATED APPLICATIONS

This application is the National Stage of International Application No. PCT/EP2009/005415, filed on Jul. 27, 2009, which claims the benefit of the priority of German Patent Application No. 10 2008 051 208.7, filed on Oct. 14, 2008. The contents of both applications are hereby incorporated by reference in their entirety.

The present invention relates to a carry basket, preferably a cardboard carry basket, having a carry basin to receive the product to be transported, and having a carry handle attached to the carry basin.

Such carry baskets are known in daily use and also from DE 697 01 457 T2 or DE 29 50 794 A1. Normally these carry baskets serve to receive the products to be transported with the basket open. This means that the products are in part accessible and can be easily removed from the carry basin. Generally speaking, such carry baskets, in particular cardboard carry baskets, are equipped with a carry handle that is attached approximately in the centre of the carry basin.

Such a cardboard carry basket, which is also equipped with a carry handle, is known for example from DE 203 15 008 U1. Also known is a carry handle for a container in accordance with DE 10 2006 049 147 A1. This text suggests a carry handle which has a grip strap to be shortened by at least one fold before use and fixed into this position. As this carry handle also has a so-called release tab, it is easily possible to release the fold if required, in order thus to be able to use the entire length of the carry handle to transport the container. All known designs have in common that the carry handles offer no support to the products arranged in the carry basin and also no means of fastening.

As a consequence, it is possible for the products held in the carry basket to knock against one another. This can at times lead to damage and/or even to glass breakages if the products are bottles, in particular glass bottles. In addition, the carry handles on the carry baskets in current use are adapted in their length to the height of the products, in order to enable stacking of the carry baskets one on top of the other, such stacking to avoid the folding down of the carry handle, which is also generally made of cardboard.

This limited length of the carry handle leads to the user having to put a hand between the products, in order to put a hand through and grip a generally prefabricated opening. As a consequence, there is a risk of injury to the user's hand during this procedure or during the subsequent carrying of the carry basket. The hand can come into direct contact with the products to be transported. This risk is particularly great in cases where the products involved are drink bottles with crown bottle caps, which are particularly sharp-edged at the top of the bottle and may as a consequence lead to injuries to the user's hand.

Finally, the carry baskets known to date are relatively expensive as regards their manufacture. This is not least due to the centrally arranged carry handle made from cardboard, which is particularly elaborate in design. The present invention is intended to overcome this.

The present invention is founded on the technical problem of further developing a carry basket of the design described above so that along with reduced manufacturing costs and equal functionality the danger of injuries can de facto be excluded. An accompanying manufacturing process will also be specified, as will a device that is particularly suited to the manufacture of the carry basket.

For solving these technical problems, a generic invention within the constraints of this invention is characterised by the carry handle being designed as a handle strap connected to at least two side walls of the carry basin and to be shortened by at least one fold before use.

Usually, both the side walls of the carry basin to which the handle strap is connected are opposite one another. However, that is not essential, because the carry strap can in principle be attached to two neighbouring side walls or even to all four side walls of the carry basin, which is usually designed as an open cuboid. The appropriate end side walls, advantageously opposite one another, would preferably be the transverse walls. The carry strap would also be most advantageously fixed to the side walls on the outside.

In this way, it can be ensured on the one hand that the handle strap passes across the carry basin from the outside, and in consequence does not affect the inside of the carry basin, which remains available as before and unchanged in size to receive the products. On the other hand, the advantageous attachment of the handle strap to the transverse walls means that any tilting effect of the carry basket about an axis passing through both fastening points is reduced to a minimum or at least is of lesser dimensions than if the handle strap were fixed to the respective longitudinal walls.

It has proved to be of value if the handle strap is attached to the corresponding side wall of the carry basin with a release tab that at least partly overlaps the fold and thereby fixes it. With the aid of the above-mentioned release tab, the fold can be removed if required. Because the release tab at least partly overlaps the fold and in an advantageous design has at least one loose end, it is possible easily to remove the release tab from the fold. Through this process, the carry handle is taken into use and the user puts it into position for use.

The handle strap, however, lies flat against the carry basin before being used, on the outside of the side walls, respectively the opposing transverse walls in this example. Because the handle strap is lying quasi flush against the carry basin and fits more or less snug against the carry basin surface, there are no points available where the handle strap could be deformed into the carrying loop before the conscious decision to make use of it. Accordingly, no damage or disruption is to be expected during transport, so that the handle strap remains undamaged and is not deformed. Not until the release tab is actively removed by the user by taking hold of the loose end is the carry loop defined.

As a rule the handle strap is divided into a fixed area and a free area. The fixed area and the free area are connected by the fold at at least one end of the free area before the handle strap is used. After the handle strap is put to use, the free area together with the fold forms the carry loop. The fixed area, in contrast, ensures that the handle strap is perfectly connected to the carry basin. For this purpose, the fixed area is completely or partly linked to the carry basin. In one version, the handle strap is composed of a central free area that has a fold either end before being used, to which the corresponding fixed area is connected on both sides. In another version, however, only one fold on one end of the free area is provided.

The release tab is connected to the fold on the one side and on the other with the product carry basin and/or the carry handle. The handle strap is generally fastened with adhesive to both or several side walls. In this way the handle strap can be manufactured from materials different to those of the carry basin. In general, the carry basin has been made from cardboard, while the handle strap is a band of plastic. Such a plastic band is on the one hand capable of absorbing considerable forces with comparably small dimensions and on the other hand is particularly cost-economic to produce. Also, handling is much easier compared to a cardboard carry handle, because the handle strap designed as described above can not only be easily positioned ready for use by the user (by removing the release tab), but is also characterised by convincingly easier handling.

In addition, the carry strap can perform a further function before use. For the handle strap, when in use, passes across the products in the carry basin and/or acts as a spacer between the products. In both cases the products are fixed before use, that is generally during transport and/or storage. This means that there is no (longer) a danger of drinks bottles knocking against one another and breaking. Rather, the products are held at a distance from one another and pressed against the side walls of the product carry basin before the handle strap is used, because the handle strap in practice acts as a spacer between the products. The products are not released until the handle strap is put in the position for use. This is not a problem insofar as the user has, generally speaking, acquired the carry basket by this stage and, for example, is transporting it home.

The handle strap is—as mentioned above—divided into a fixed area and a free area. The fixed area is completely or partially connected to the container, usually by adhesive. The free area, in contrast, passes across the products and/or an opening of the carry basin before being used. After the handle strap is put to use, the free area together with the fold forms the carry loop mention above.

In order for the user, when carrying the carry basket that is the object of this invention, not to come into contact, after putting the handle strap into use and creating the carry loop, with the products stored in the basket, the carry loop is devised to have sufficient length for a handle area to be defined for the user. This handle area is set to be higher than at least the amount of an average through grip's height above the tallest of the products in the carry basket. This means that at least the average through grip height will be added to the height of the tallest product, which guarantees that the user will be able to pass an open hand through this grip height. The handle area defined by the release tab will be above this average grip height.

Also an object of the invention is the use of a handle strap shortened by at least one fold and fixed in that position, namely as a carry handle attached to the carry basin of a carry basket for products. For this purpose it is of advantage to have a release tab that at least partially overlaps and thereby fixes the handle strap. The handle strap is here usually attached to two transverse side walls of the carry basins, with the carry basin designed as an open cuboid.

In addition the invention relates to a procedure for manufacturing such a carry basket. In this regard, a punched blank is initially produced to define the carry basin and then folded. Thereupon the carry basin may as an option be filled with products. Finally, the handle strap, shortened by at least one fold, is attached to at least two side walls of the carry basin as a carry handle. If the carry basin has not previously been filled with products, these can now be placed in the carry basin. Usually, however, the attachment of the handle strap to the carry basin is performed when the products have already been put into the carry basin. This provides the carry basin with additional stability and makes it easy to equip it with the handle strap. In addition, the handle strap may be easily passed between the products as a spacer in this procedure. For this purpose, the handle strap is usually placed tightly above the opening of the carry basin.

Finally, the invention relates to a machine for manufacturing such a basket. The machine is equipped with a punching device for producing punched blanks from the raw material. There is also a folding device, which folds the punched blank to form the carry basin. In addition, a product dispensing unit for the products is provided, as is a strap dispensing unit. With the aid of the product dispensing unit, the carry basin may—as described—be filled with products before the handle strap is subsequently attached. It is however also possible, with the aid of the product dispensing unit, to place the products in the carry basin after the handle strap has been attached.

The strap dispensing device ensures that the handle strap is dispensed in the prescribed length and is attached as a carry strap shortened by at least one fold to at least two side walls of the carry basin. This means that the strap dispensing unit not only ensures the feeding of the handle strap at the required length, but at the same time also the attachment of the handle strap to the side walls of the carry basin, taking into account the carry handle shortened by the fold and defined as such.

The result is a carry basket that is particularly economical to produce. For it is in the end necessary only to define the basket's carry basin with a cardboard blank. The carry handle, on the other hand, which is of itself expensive, is here a carry strap which can be economically manufactured from plastic.

In addition, the carry handle has been shortened by at least one fold before being put to use and after being taken into use has a length that allows a problem-free grip on the part of the user. Any injuries can therefore be excluded.

Finally, the procedures and therefore also the machinery and plant for manufacturing the carry basket have been simplified, which also lowers the costs. The major advantages can be seen here.

Figure 1B:
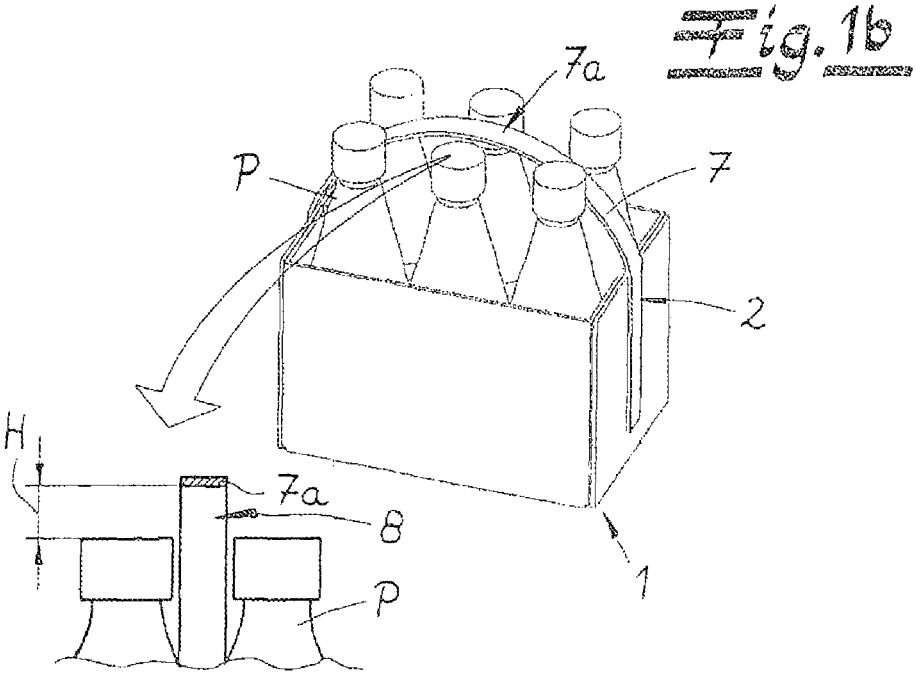

Below, the invention is described in more detail by a drawing which shows only one sample design; the following figures show:

FIG. 1*a* the carry basket relevant to the invention before being used,

FIG. 1*b* the object in FIG. 1*a* after being put to use and

Figure 2:
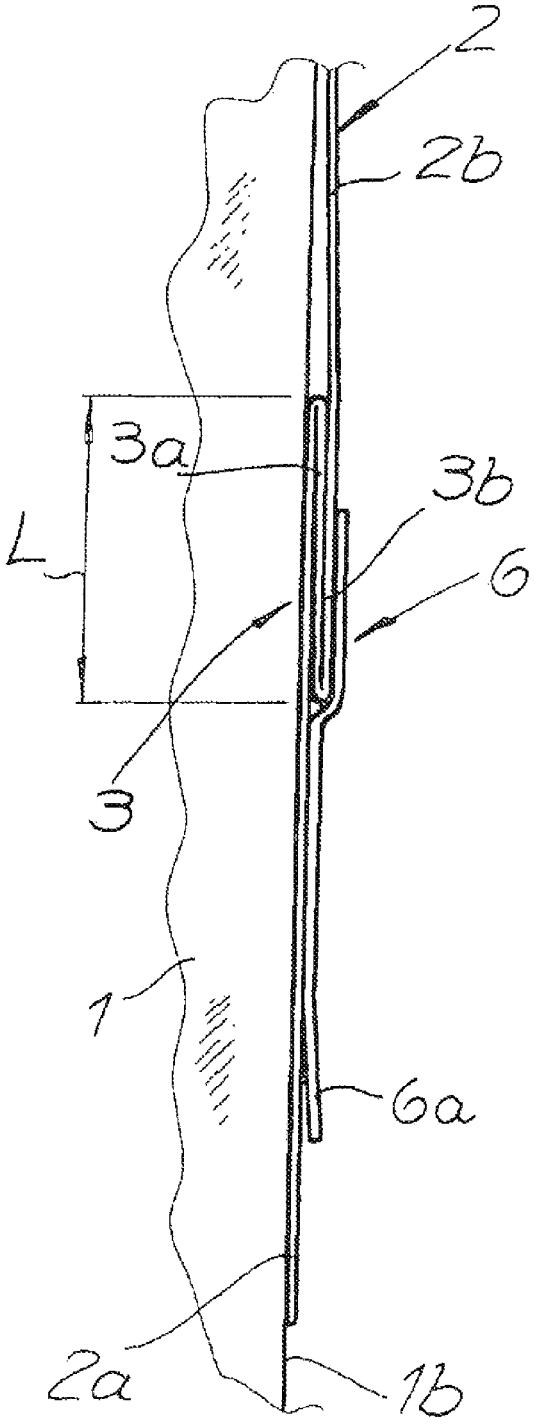

FIG. 2 a detailed view of the carry basket in the area where the strap is attached.

In FIGS. 1*a* and 1*b* a carry basket is portrayed which is essentially of a two-part construction and consists of the carry basin 1 and a carry handle 2 attached to the carry basin 1. The carry basin 1 is devised as a cardboard carry basin 1. The carry basket displayed is therefore a cardboard carry basket, that is to say, a carry basket consisting for the most part of cardboard, for example made from paper or card.

One can see that the carry basin 1 is designed as a cuboid open at the top to receive products, which is of course not an essential condition. In the example, the products P are drinks bottles.

It is clear that according to the drawing in FIG. 1*a* the carry handle 2 is shortened before being put to use by at least one fold 3. The carry handle 2 is also, in the example shown, attached to two side walls 1*a*, in this sample version to two transverse side walls 1*a* of the carry basin 1 which is shaped like a cuboid open at the top. Both transverse side walls 1*a* lie opposite one another, as do the accompanying longitudinal side walls 1*b* of the carry basin 1.

Before use of the carry strap 2 and during transport, the carry strap lies flat and more or less snug against the carry basin 1. This can be seen from FIGS. 1*a* and 2, which also clearly show that carry handle 2, respectively the handle strap 2 shortened by fold 3 and formed in this way, passes across an opening 4 of the carry basin 1. For this purpose the carry handle 2 or respectively the handle strap 2 is in each case fitted tightly across the opening 4, so that the handle strap 2 in the example acts as a spacer for the products P. The handle strap 2 does in fact pass between the products P, thus running along a lengthwise dividing surface 5. This means the products P are fixed to one another and also pressed to both longitudinal side walls 1*b* and the two transverse side walls 1*a* on the inside. In this way, any transport and/or storage problems of the products P occurring before the handle strap 2 is used according to the drawing FIG. 1*a* can be reliably avoided.

In the transport position before use represented according to FIG. 1*a*, the handle strap 2 is shortened by the fold 3 described above. The handle strap 2 is here fixed in this shortened position. To fix the fold 3 or respectively the handle strap 2 in the shortened position, the invention proposes a release tab 6, which can be seen particularly clearly in the detailed view according to FIG. 2. To fix the fold 3, the release tab 6 overlaps the corresponding fold 3, at least in part.

As explained above, the handle strap 2 lies flat against the side walls 1*a* of the carrying basin 1 before use, on the outside of these side walls 1*a*. After being put to use by removing the release tab 6 the handle strap 2 forms a carry loop 7, as can be seen in FIG. 1*b*. The greater length of the carry loop 7 in the use position as in FIG. 1*b* compared to the handle strap 2 before use results from fold 3, which is released for use by removing release tab 6.

The handle strap 2 is essentially composed of a fixed area 2*a* and a free area 2*b*. Comparing the view of FIGS. 1*a*, 1*b* and 2, it can be seen that the handle strap 2 has two fixed areas 2*a* where it is attached to the sides walls 1*a* of the carry basin 1 and one free area 2*b* placed between the fixed areas 2*a*. The fold 3 in the sample version is provided only at one end of the free area 2*b*, namely at the right end, and consequently links the relevant (right) area of the free area 2*b* to the fixed area 2*a*, and this is for cost reasons. Naturally both ends of the free area 2*b* can also end in a fold 3, to either end of which a fixed area 2*a* is joined.

The fixed area 2*a* of the handle strap 2 is completely or partly attached to the carry basin 1, namely the corresponding side wall surfaces 1*a* in the sample version. For this purpose a liquid or respectively a hot-melt adhesive may be sprayed onto the handle strap 2 before it is attached to the carry basin 1 or respectively onto the corresponding side wall surfaces 1*a*. The adhesive will be applied to the strap surface facing the carry basin 1. In contrast, the surface of the handle strap 2 that faces outwards remains free or at most has a protective coating or may display an (advertising) print. The same applies to the release tab 6, which may also be equipped with a print on the outward facing surface. A coating of adhesive is not provided here.—Both the handle strap 2 and the release tab 6 are essentially comprised of rectangular plastic bands, which may be manufactured for example from PE (polyethylene), PP (polypropylene) or similar materials.

In the detailed view in FIG. 2 it can be seen that the fold 3 has at least two folded loops 3*a*, 3*b*, one lying on top of the other. In fact, a fixing folded loop 3*a* has been realised attached to the fixed area 2*a*, as has a free folded loop attached to the free area 2*b*. Both folded loops 3*a*, 3*b* lie on top of one another in the area length L. Length L represents the extension of the handle strap 2 in transition from the transport position as in FIG. 1*a* to the use position in FIG. 1*b* or respectively determines this extension.

The extension of the handle strap 2 has been measured to provide the carry loop 7 with a sufficient total length to define a handle area 7*a* for the user. This handle area 7*a* is higher by at least the amount of an average through grip H or respectively the associated through grip 8 above the tallest of the products P to be found in the carry basket 1. The through grip area H has been measured to allow an adult to pass an open hand through and clasp the hand around the handle area 7*a*. As a consequence the hand will always remain above the products P and the tallest product when carrying the carry basket. Injuries such as those described in the introduction can therefore be excluded.

Both the folded loops 3*a*, 3*b* can be connected to one another in a detachable manner at their facing inside surfaces. Usually the release tab 6 fixing fold 3 is sufficient to ensure that fold 3 does not open unintentionally or respectively handle strap 2 does not form carry loop 7 in an unplanned manner. For this purpose, the release tab 6 at least partly overlaps the free fold loop 3*b*, so it is therefore combined with fold 3 on the one hand and the free fold loop 3*b* here. On the other hand release tab 6 is also connected to carry basin 1. In the detail, release tab 6 is attached to fixed area 2*a* of the handle strap 2. For this purpose, release tab 6 may be devised as an adhesive band with a layer of adhesive on one side of the handle strap 2 and the side facing fold 3. However, one loose end 6*a* of the release tab 6 must be omitted here, which consequently has no adhesive coating. The loose end 6*a* serves to manually remove the release tab 6 from fold 3 when handle strap 2 is put to use.

The handle strap 2 and the release tab 6 may each have approximately the same width. It has also proved to be beneficial if handle strap 2 and release tab 6 are arranged on or run along the carry basin 1 in the same lengthways arrangement. It becomes clear from FIG. 2 that the fixed area 2*a* of the handle strap 2 extends further than the release tab 6 and its loose end 6*a* lengthways. However, it is also possible that the loose end 6*a* of the release tab 6 and the end of the fixed area 2*a* or the carry strap 2 coincide or respectively that the end of the fixed area 2*a* is covered by the loose end 6.

The invention claimed is:

1. A carry basket comprising: a carry basin to receive products; and a carry handle attached to the carry basin; the carry handle including a handle strap having a fixed length, said handle strap being attached to at least two side walls of the carry basin, the handle strap transitioning between a first state, before use, in which said handle strap is folded and a second state in which the handle strap is unfolded, wherein in the first state, the handle strap acts as a spacer between the products and causes said products to be pressed against said side walls, thereby fixing said products and preventing said products from knocking against each other, and wherein in the second state, the handle strap passes over the products carried in the carry basin, thereby enabling the carry basin to be carried by the handle strap, and releases said products.

2. The carry basket of claim 1, further comprising a release tab that overlaps the fold, thereby fixing the handle strap to a side wall of the carry basin.

3. The carry basket of claim 2, wherein the release tab comprises at least one loose end for the manual removal of the fold before use.

4. The carry basket of claim 2, wherein the release tab connects with the fold on one side thereof and wherein the release tab connects with the carry basin on another side thereof.

5. The carry basket of claim 1, wherein the handle strap is fixed to the outside of opposite side walls of the carry basket.

6. The carry basket of claim 1, wherein the handle strap and the carry basin comprise different materials.

7. The carry basket of claim 1, wherein the handle strap is divided into a fixed area and a free area that are separated from each other by said fold.

8. The carry basket of claim 7, wherein the fixed area is at least partly connected to the carry basin, and wherein, before use of the handle strap, the free area reaches between the products in the carry basin and, wherein after the handle strap is taken into use, the free area and the fold together form a carry loop.

9. The carry basket of claim 8, wherein the carry loop has sufficient length to define a handle area for a user thereof, the handle area being arranged so as to have a through grip height sufficient to provide clearance for the user's hand between the carry loop and the tallest of the products in the carry basket.

10. The carry basket of claim 1, wherein the carry handle comprises cardboard.

11. The carry basket of claim 5, wherein the opposite side walls are transverse side walls of the carry basket.

12. The carry basket of claim 6, wherein the handle strap comprises plastic.

13. The carry basket of claim 7, wherein the fixed area is at least partly connected to the carry basin, and wherein, before use of the handle strap, the free area reaches across an opening in the carry basin and, wherein after the handle strap is taken into use, the free area and the fold together form a carry loop.

14. The carry basket of claim 2, wherein the release tab connects with the fold on one side thereof and wherein the release tab connects with the handle strap on an other side thereof.

15. The carry basket of claim 2, wherein the release tab connects with the fold on one side thereof and wherein the release tab connects with the carry basin on an other side thereof.

16. The carry basket of claim 1, wherein the carry basket comprises cardboard.

17. A manufacture comprising a carry basket, said carry basket comprising a carry basin to receive products, and a carry handle, wherein said carry handle comprises a first end, a second end, and a handle strap, wherein said handle strap comprises a folding section, wherein said first end is fixed to a first side of said carry basin, wherein said second end is fixed to second side of said carry basin, wherein said folding section transitions between a first folding-section state and a second folding-section state, wherein when said folding section is in said first folding-section state, said folding section maintains a first folding-section length, wherein when said folding section is in said second folding-section state, said folding section maintains a second folding-section length, wherein said handle strap transitions between a first handle-strap state and a second handle-strap state, wherein in said first handle-strap state, said handle strap maintains a first handle-length, wherein in said second handle-strap state, said handle strap maintains a second handle-length, wherein said second handle-length is greater than said first handle-length by an amount that depends on a difference between said first folding-section length and said second folding-section length, wherein when said handle strap is in said first handle-strap state, said handle strap extends straight across said carry basin along a first path such that said handle strap separates products carried in said carry basin, wherein said handle strap restricts travel of said products in a direction perpendicular to said first path, wherein when said handle strap is in said second handle-strap state, said handle strap extends across said carry basin along a second path, said second path defining an arc that extends over said carry basin, thereby enabling said carry basin to be carried by said handle strap.

* * * * *